US006227162B1

(12) United States Patent
Dahlberg et al.

(10) Patent No.: US 6,227,162 B1
(45) Date of Patent: May 8, 2001

(54) SYSTEM FOR CLEANING OF INTAKE AIR

(75) Inventors: Göran Dahlberg; Mikael Adolfsson, both of Gränna (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/180,587

(22) PCT Filed: May 21, 1997

(86) PCT No.: PCT/SE97/00824

§ 371 Date: Nov. 12, 1998

§ 102(e) Date: Nov. 12, 1998

(87) PCT Pub. No.: WO97/44582

PCT Pub. Date: Nov. 27, 1997

(30) Foreign Application Priority Data

May 21, 1996 (SE) ..... 9601925

(51) Int. Cl.[7] ..... F02B 77/04
(52) U.S. Cl. ..... 123/198 E; 123/41.56
(58) Field of Search ..... 123/41.56, 41.7, 123/41.65, 198 E

(56) References Cited

U.S. PATENT DOCUMENTS

| | | | | |
|---|---|---|---|---|
| 4,233,043 | | 11/1980 | Catterson | 55/315 |
| 4,537,160 | * | 8/1985 | Shirai | 123/41.58 |
| 5,363,815 | | 11/1994 | Pretzsch et al. | 123/41.7 |
| 5,367,988 | | 11/1994 | Collins | 123/41.65 |

FOREIGN PATENT DOCUMENTS 3708289 2/1991 (DE) .

* cited by examiner

*Primary Examiner*—Willis R. Wolfe
*Assistant Examiner*—Katrina B. Harris
(74) *Attorney, Agent, or Firm*—Pearne & Gordon LLP

(57) ABSTRACT

A system (1) for cleaning of intake air (2) for a fan-cooled combustion engine intended for a working tool, such as a chain saw, cutting machine, grasstrimmer or lawn-mower, whose engine is equipped with a fan wheel (3) enclosed in a fan cover (4) for cooling of the engine. A flow duct (5) is connected to the fan cover (4) at least at one of its both ends (6, 7), and a deflection duct (8) is arranged in the wall of the flow duct (5), so that the ducts (5, 8) are forming a T-like crossing, and the deflection duct leads to the engine's inlet duct (9), usually via an inlet volume (10) and a filter (11).

20 Claims, 2 Drawing Sheets

SYSTEM FOR CLEANING OF INTAKE AIR

TECHNICAL FIELD

The subject invention refers to a system for cleaning of intake air for a fan-cooled combustion engine intended for a working tool, such as a chain saw, cutting machine, grasstrimmer or lawn-mower, whose engine is equipped with a fan wheel enclosed in a fan cover for cooling of the engine.

BACKGROUND OF THE INVENTION

Many types of working tools, such as chain saws, cutting machines, grasstrimmers or lawn-mowers operate in dirty environments. These tools themselves are supplying the surrounding air with a lot of particles from wood, concrete, grass etc., as well as exhaust gases. Traditionally airfilters are used for cleaning the intake air to the engine. However, these airfilters will soon be stopped up by larger or smaller particles and must therefore be exchanged and cleaned often. Different types of deflection cleaners have been designed in order to clean the intake air before it reaches the airfilter. In several cases the deflection takes place at the inlet of a duct or similar, which debouches in the cooling air outlet. Examples of such solutions are shown in DE 44 20 530, DE 42 03 885, U.S. Pat. No. 5,317,997, SE 93 02 187. The cooling air outlet has a substantially varying cross section in its longitudinal direction. Firstly it expands heavily at the very outlet as from the fan wheel after it will be compressed against the cooling fins of the cylinder. Among other things this leads to a high extent of turbulence in the cooling air outlet. In order to achieve a satisfactory cleaning effect it is therefore important that the flow at the deflection point has high speed and low turbulence to prevent the particles from being deflected. By testing of deflection cleaners with deflection ducts running into the cooling air outlet, it has turned out that the placing of the deflection point in the cooling air outlet is very decisive, in particular since the turbulence picture in the cooling air outlet also is affected by the engine speed. Furthermore these solutions often lead to a complicated drawing of the deflection duct as well as a complicated design at the deflection point. DE 29 03 832 shows a new cleaning air system, which utilizes air cleaning by deflection in two different steps. As described above the first deflection takes place at the inlet of an intake air duct, which runs into the cooling air outlet, resulting in the disadvantages earlier described. The intake air duct then leads in underneath the air filter house. A lot of holes are drilled in the connecting wall between the intake air duct and the air filter house. Those holes are so arranged that most of them are placed downstreams other holes. This means that the upstream hole creates an extra turbulence in the duct and this turbulence contributes to reduce the cleaning effect in the downstream hole. Furthermore are several holes placed entirely at the end of the duct which also creates turbulence and reduces the cleaning effect. Moreover the intake air duct has not an even section but varies. The whole duct is, on the one hand poorly widening in its whole length, and on the other hand there is a strong throttling just upstreams that area with holes. The filter house is simply being partly immersed into the intake air duct. This creates a strong turbulence upstreams the deflection holes and this turbulence contributes to reducing the cleaning effect in every hole. Furthermore the inlet mouth of the intake air duct is placed in one part of the cooling air outlet which has a rapidly varying cross section where accordingly the turbulence is great. For cleaning purposes a strong deflection takes place into the intake air duct. This means that the incoming air to the intake air duct has high turbulence and low speed. Naturally, this is very negative with regard to the cleaning result in the second step. Moreover, as mentioned above, there is also a lot of turbulence creating disturbances at the area of the deflection openings. These openings are increasing the turbulence even more. This means that the deflection is taking place in two steps while the cleaning result in the last step will become very poor at the same time as there is a risk that the cleaning result in the first step will be poor at many engine speed-dranges.

PURPOSE OF THE INVENTION

The purpose of the subject invention is to substantially reduce the above outlined problems.

SUMMARY OF THE INVENTION

The above mentioned purpose is achieved in a system for cleaning of intake air, in accordance with the invention, having the characteristics appearing from the appended claims.

The system for cleaning of intake air according to the invention is thus essentially characterized in that a flow duct is connected to the fan cover, at least at one side of its both ends, and a deflection duct is arranged in the wall of the flow duct, so that the ducts form a T-like crossing, and the deflection duct leads to the inlet duct of the engine, usually via an inlet volume and a filter. Consequently, in comparison with earlier known solutions a flow duct has been added and the deflection is taking place from the flow duct into the deflection duct. From a cleaning point of view the main purpose of the flow duct is to create a advantageous flow, i.e. a flow with high speed and low turbulence at different engine speeds. From this point of view it can be given a design which is much more advantageous than that of the cooling air outlet. Furthermore the both ducts can be given a very simple design which also reduces the risk of stopping-up. These and other characteristic features and advantages of the invention will become more apparent from the following detailed description of various embodiments with the support of the annexed drawing.

BRIEF DESCRIPTION OF THE DRAWING

The invention will be described in closer detail in the following by way of various embodiments thereof with reference to the accompanying drawing, in which the same numbers in the different figures state one another's corresponding parts.

In FIG. 1 numeral 5 designates a flow duct with two ends 6, 7. A deflection duct 8 connects to flow duct 5. Both ducts can each have a round, oval or rectangular section. The joint between the both ducts can be arranged in many different ways, e.g. two ducts made of plastic material can be welded together. Preferably the flow duct 5 is arranged with an opening, around which the deflection duct 8 connects, for example by welding, as mentioned above, or by being provided with a sealing and being pressed against the duct 5. The deflection duct 8 is arranged in the wall of the flow duct 5 so that the ducts are forming a T-like crossing, and the deflection duct 8 leads to the engine's inlet duct 9, usually via an inlet volume 10 and a filter 11. If the engine is running this means that a suction is created in the deflection duct 8 at the same time as an air stream is forced through the flow duct 5 by means of the engine's cooling fan. Upstreams the deflection duct 8 there is a flow of upstream air 12. From this air flow 12 another flow of deflected air 13 is deflected in the deflection duct 8. The remaining air will continue as downstream air 14 in the flow duct 5. The upstream air flow 12 contains a lot of pollution, mainly in form of different particles. For a chainsaw it can be a question of larger or smaller particles from wood. These particles are more heavy than the air itself and as a consequence of this matter they find it more difficult to be deflected than the air itself. Hereby a cleaning effect is achieved, so that almost 100 percent of the particles in the air will continue among the downstream air 14, and will not be deflected and go on as deflected air 13. As appears from the figure the deflection of air is larger than 90°. This contributes to a satisfactory cleaning effect. Furthermore the flow duct 5 preferably has a nearly constant cross-section area in its flow duct. Hereby a regular flow without any disturbing turbulence is created. For the cleaning result it is important that the flow in the duct 5 has high speed and low turbulence. This is secured by the fact that the deflection takes place in a special duct, which is especially favourably designed for this purpose. In this respect it differs from deflection ducts connected to a cooling air outlet in a fan-cooled engine. Such an outlet has a substantially varying cross-section area and a very disturbed air flow. The flow duct 5 has thus an essentially constant, or just slightly changeable, cross-section area within the zone of and somewhat upstreams and downstreams the T-like crossing of the two ducts 5,8. This is especially important in the deflection zone, but normally the whole flow duct 5 is designed with an essentially constant cross-section area along its whole length. The deflection duct 8 forms an angle in relation to the upstream side of the flow duct 5 by maximum 90° and thereby the deflected air will be deflected at least 90°.

FIG. 2 shows schematically a cross-sectional view through fan wheel 3, fan cover 4, flow duct 5, deflection duct 8, inlet volume 10, filter 11 and inlet duct 9. The flow duct 5 is connected to fan cover 4 at a position with an overpressure, while the other end 7 of the flow duct 5 debouches in the open air surrounding the working tool. Thereby air will flow from the end 6 at the fan cover, on to the end 7, as well as into the deflection duct 8. In the shown case the fan wheel 3 is mainly radially acting and the fan cover 4 is arranged as a so called fan worm, which eccentrically surrounds the fan wheel. The fan wheel 3 is usually mounted on the engine's crankshaft 18. The flow duct 5 is connected to the fan cover 4 in a position where the radial distance between the fan wheel 3 and the fan cover is small, i.e. in a position far upstreams the fan's outlet 15. This means that air will flow along the periphery of the fan cover 4 according to the drawn arrows. The flow duct 5 is connected to an opening in the periphery of the fan cover 4. A flow 12 runs into the duct 5. The duct 5 connects to the periphery of the fan cover in an essentially tangential direction. The connection of the duct 5 is thus so arranged that the air can flow almost tangentially into the duct 5. This contributes to a flow with high speed and low turbulence in the duct 5 which is important as to the cleaning result. In normal cases the amount of air 12 in the flow duct 5 represents approximately 15 percent of the total amount of air leaving the fan. It is also important that the air flow is considerably larger than that air flow meant to be used downstreams as intake air. If both air flows should be of the same size there shouldn't be any cleaning effect as well. A heavy deflection at the inlet of the duct 5 should, on the one hand reduce the air flow, and on the other hand cause a strong turbulence. In both cases the cleaning effect would be reduced in a following deflection. Approximately a third of the upstream air 12 is deflected and will become deflected air 13 in the deflection duct 8. The remaining air continues as downstream air 14 in the flow duct 5 and blows out in the surrounding air. Thus it seems as approximately 10 percent of the total amount of the air from the fan is being lost as downstream air 14. But this is not quite true since more conventional air cleaning devices arranged in the fan's outlet 15 would increase the back pressure in the outlet. Hereby the total amount of air will be somewhat reduced in those cases. The deflected air 13 flows into an inlet volume 10, such as an inlet muffler 10, in order to pass by a filter 11 and a fuel supply device 19, such as a carburetor, and via the engine's inlet duct reach the engine's cylinder, which is not shown in the figures.

FIG. 3 shows an embodiment of the cleaning system in which one end 6 of the flow duct 5 is connected to the fan cover 4 at a position with an underpressure, while the other end 7 of the flow duct 5 debouches in the open air surrounding the working tool. Hereby air is flowing from the end 7 at the surrounding air to the end 6, as well as into the deflection duct 8. The conditions for inflowing of air into the duct will be advantageous with low turbulence and high speed. FIG. 3 shows, exactly as in FIG. 2, a cross-sectional view through the flow duct 5, the deflection duct 8, the inlet volume 10, the filter 11 and the inlet duct 9. The fan wheel 3 and the fan cover 4 on the other hand, are located behind the cross-sectional plane. This is due to the fact that the flow duct 5 at its end 6 turns backwards and connects to inlet hole 17 which is located in the fan cover 4. The inlet hole has an outer edge 16. The inner parts of the fan wheel 3 are thus to be seen through the inlet hole 17, while the outer parts situated outside the outer edge 16 of the inlet hole 17 are hidden by the fan cover 4. Consequently, the flow duct 5 deflects at the end 6 so that it connects to the fan cover 4 in an axial direction and in a position near the outer edge 16 of the fan cover's inlet hole 17 and far upstreams the fan's outlet 15. This location is preferable from several points of view at the same time as the location can be varied quite a lot within the scope of the invention. The important thing is that the end 6 connects to the fan cover 4 at a position where a relatively strong underpressure exists. For, it is important that the air flow in the flow duct 5 is rapid. As earlier mentioned, some of the upstream air 12 is deflected into deflected air 13. What is mentioned regarding the earlier figures is also applicable in this case. An advantage in this case is that no air is lost owing to the usage of the flow duct 5. Also, in principle it would be possible to connect the end 7 to a overpressure side of the fan cover 4. In this manner the flow duct 5 could function as a flow loop between the overpressure side and the underpressure side of the fan cover. However, this will result in a complicated drawing of the duct and has hardly any advantages in comparison with the preferred embodiments. In the shown examples the cleaning system with the ducts 5 and 8 are used in connection with an essentially radially acting fan. Obviously it could also be used in combination with an axially acting propeller fan or some form of a cross between an axially and a radially acting fan. For, in all types of fans there are positions with an overpressure as well as positions with an underpressure so that the flow duct 5 can be connected at a suitable position.

Figure 1:
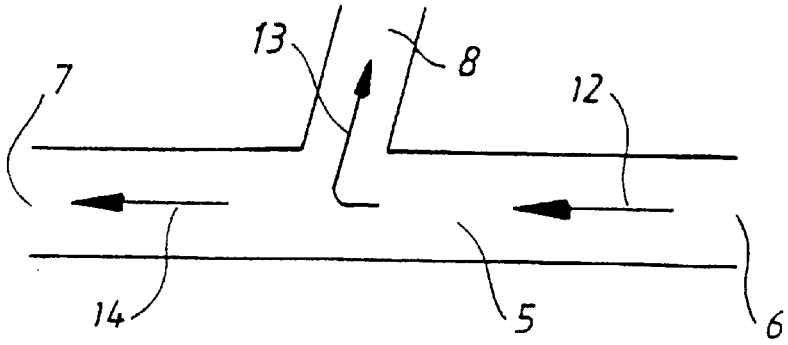
FIG. 1 illustrates schematically a system for cleaning of intake air in accordance with the invention. A flow duct and a deflection duct are forming a T-like crossing.
Figure 2:
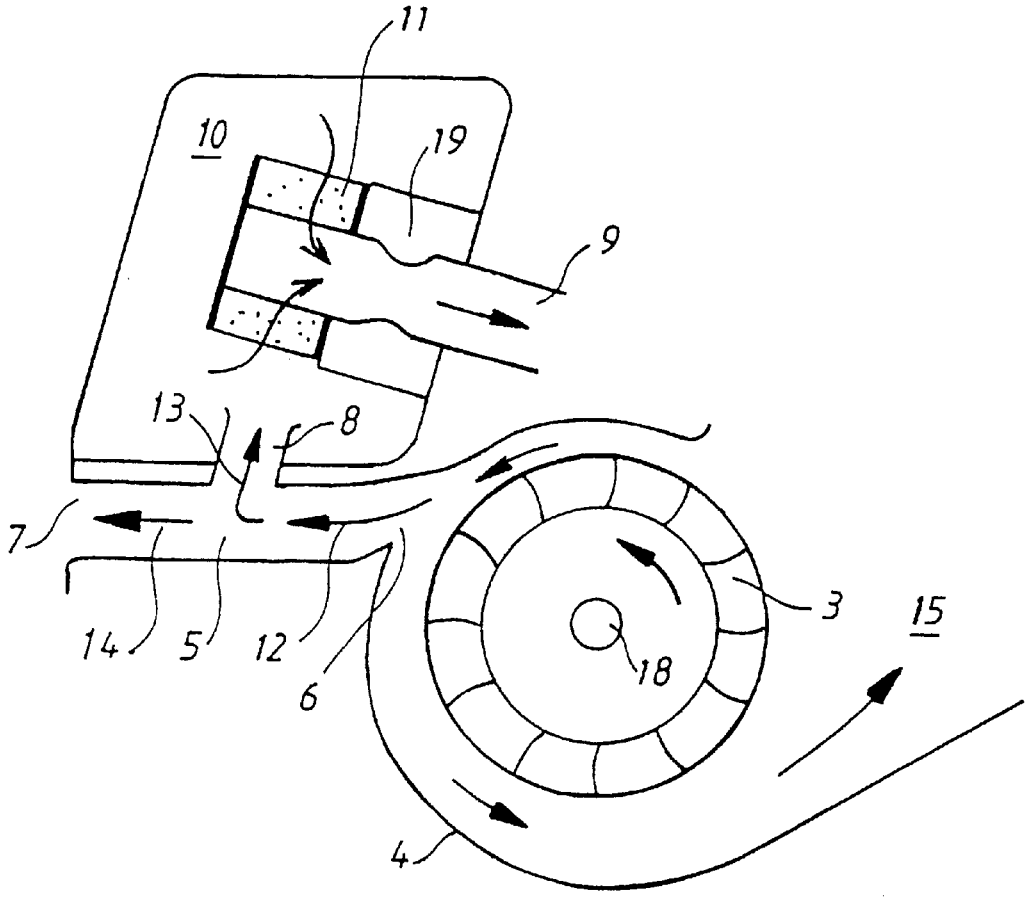
FIG. 2 illustrates schematically an embodiment where the flow duct at one end is connected to the pressure side of the engine's cooling fan, while its other end leads out to the open air surrounding the working tool.
Figure 3:
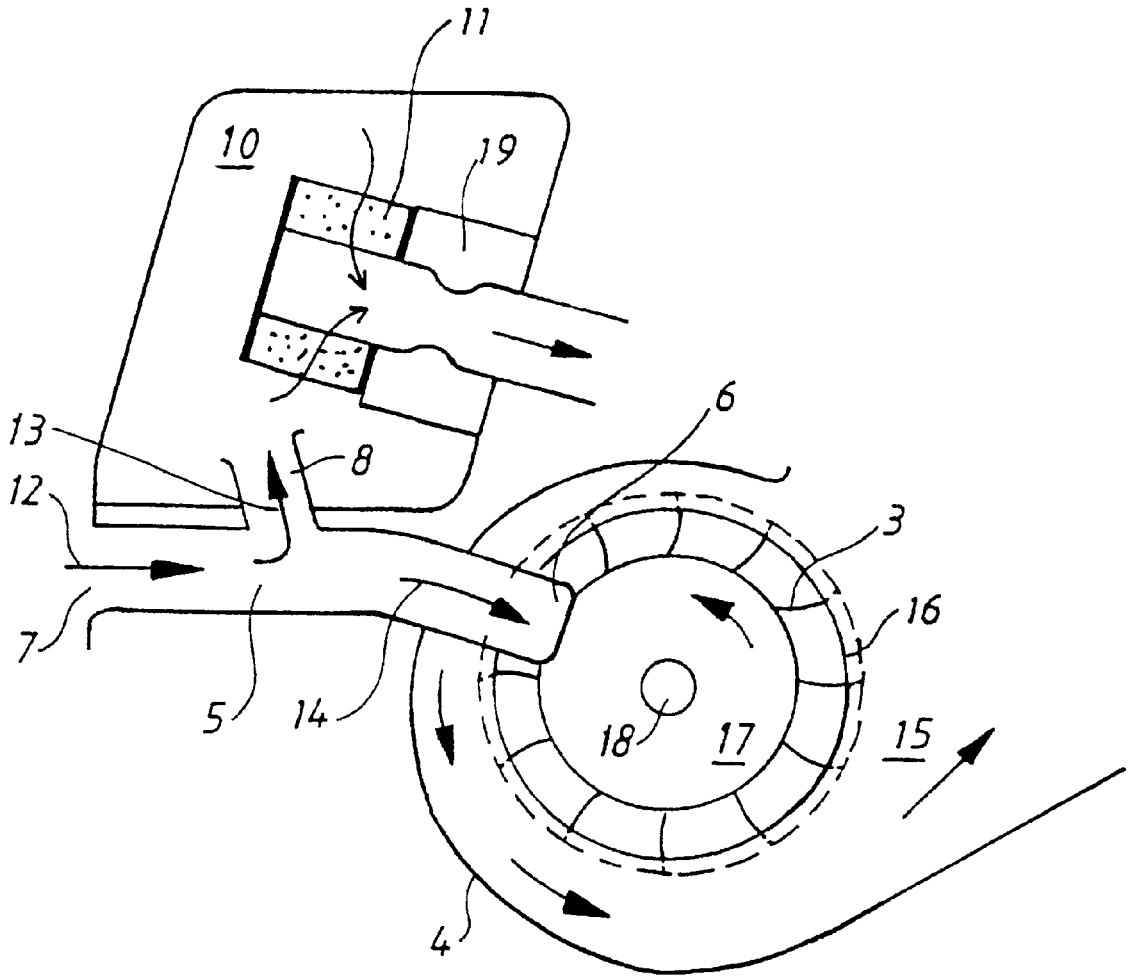
FIG. 3 illustrates schematically another embodiment in which one end of the flow duct is connected to the suction side of the cooling fan, while the other end of the flow duct is connected to the surrounding air.

What is claimed is:

1. A system (1) for cleaning of intake air (2) for a fan-cooled combustion engine intended for a working tool, said engine having a fan wheel (3) enclosed in a fan cover (4) for cooling of the engine, a flow duct (5) having two ends (6, 7) and being smoothly connected to the fan cover (4) at least one of said two ends (6, 7) by an intake to the flow duct (5) to substantially avoid deflection of intake air, thereby substantially avoiding the generation of turbelence in the intake air, and a deflection duct (8) being arranged in the wall of the flow duct (5), so that the flow and deflection ducts (5, 8) form a T-like crossing, the deflection duct leading to an engine inlet duct (9).

2. A system (1) for cleaning of intake air (2) according to claim 1, wherein one end (6) of the flow duct (5) is connected to the fan cover (4) at a position with an overpressure, while the other end (7) of the flow duct (5) debouches in the open air surrounding the working tool, and thereby air flows from the one end (6) at the fan cover to the other end (7), as well as into the deflection duct (8).

3. A system (1) for cleaning of intake air (2) according to claim 1, wherein one end (6) of the flow duct (5) is connected to the fan cover (4) at a position with an underpressure, while the other end (7) of the flow duct (5) debouches in the open air surrounding the working tool, and thereby air flows from the other end (7) to the one end (6), as well as into the deflection duct (8).

4. A system (1) for cleaning of intake air (2) according to claim 1, wherein the flow duct (5) has an essentially constant cross-sectional area in the vicinity of the T-like crossing between the flow and deflection ducts (5, 8).

5. A system (1) for cleaning of intake air (2) according to claim 1, wherein the flow duct (5) has an essentially constant cross-sectional area along its whole length.

6. A system (1) for cleaning of intake air (2) according to claim 1, wherein the deflection duct (8) forms an angle of no more than 90° with the flow duct (5) such that deflected air (13) will be deflected at an angle of at least 90° from downstream air (14).

7. A system (1) for cleaning of intake air (2) according to claim 1, wherein the fan wheel (3) causes substantial radial air movement and wherein the fan cover (4) is a fan worm which eccentrically surrounds the fan wheel.

8. A system (1) for cleaning of intake air (2) according to claim 2, wherein the flow duct (5) is connected to the fan cover (4) in a position where a radial distance between the fan wheel (3) and the fan cover is small.

9. A system (1) for cleaning of intake air (2) according to claim 3, wherein the flow duct (5) is connected to the fan cover (4) near an outer edge (16) of a fan cover inlet hole (17) and upstream of a fan outlet (15).

10. A system (1) for cleaning of intake air (2) according to claim 2, wherein the flow duct (5) has an essentially constant cross-sectional area in the vicinity of the T-like crossing between the flow and deflection ducts (5, 8).

11. A system (1) for cleaning of intake air (2) according to claim 3, wherein the flow duct (5) has an essentially constant cross-sectional area in the vicinity of the T-like crossing between the flow and deflection ducts (5, 8).

12. A system (1) for cleaning of intake air (2) according to claim 2, wherein the flow duct (5) has an essentially constant cross-sectional area along its whole length.

13. A system (1) for cleaning of intake air (2) according to claim 3, wherein the flow duct (5) has an essentially constant cross-sectional area along its whole length.

14. A system (1) for cleaning of intake air (2) according to claim 2, wherein the fan wheel (3) is mainly radially acting and wherein the fan cover (4) is a fan worm which eccentrically surrounds the fan wheel.

15. A system (1) for cleaning of intake air (2) according to claim 3, wherein the fan wheel (3) is mainly radially acting and wherein the fan cover (4) is a fan worm which eccentrically surrounds the fan wheel.

16. A system (1) for cleaning of intake air (2) according to claim 4, wherein the fan wheel (3) is mainly radially acting and wherein the fan cover (4) is a fan worm which eccentrically surrounds the fan wheel.

17. A system (1) for cleaning of intake air (2) according to claim 4, wherein the flow duct (5) is connected to the fan cover (4) in a position where a radial distance between the fan wheel (3) and the fan cover is small.

18. A system (1) for cleaning of intake air (2) according to claim 4, wherein the flow duct (5) is connected to the fan cover (4) near an outer edge (16) of a fan cover inlet hole (17) and upstream a fan outlet (15).

19. A system (1) for cleaning of intake air (2) according to claim 7, wherein the flow duct (5) is connected to the fan cover (4) in a position where a radial distance between the fan wheel (3) and the fan cover is small.

20. A system (1) for cleaning of intake air (2) according to claim 7, wherein the flow duct (5) is connected to the fan cover (4) near an outer edge (16) of a fan cover inlet hole (17) and upstream a fan outlet (15).

* * * * *

UNITED STATES PATENT AND TRADEMARK OFFICE

CERTIFICATE OF CORRECTION

PATENT NO. : 6,227,162 B1
DATED : May 8, 2001
INVENTOR(S) : Dahlberg et al.

It is certified that error appears in the above-identified patent and that said Letters Patent is hereby corrected as shown below:

Column 5,
Line 12, after "least", insert -- at --.

Signed and Sealed this

Twenty-sixth Day of March, 2002

*Attest:*

*Attesting Officer*

JAMES E. ROGAN
*Director of the United States Patent and Trademark Office*